United States Patent [19]

Hussey

[11] Patent Number: 4,499,970

[45] Date of Patent: Feb. 19, 1985

[54] WAYSIDE WHEELCHAIR LIFT

[75] Inventor: Ian G. Hussey, Oakland, Calif.

[73] Assignee: Environmental Equipment Corporation, San Leandro, Calif.

[21] Appl. No.: 392,085

[22] Filed: Jun. 25, 1982

[51] Int. Cl.[3] ..... B66B 9/20

[52] U.S. Cl. ..... 187/9 R; 414/921; 187/8.72

[58] Field of Search ..... 187/9 R, 8.71, 8.72, 187/18; 414/921, 546, 556; 254/10 C, 10 R, 8 R, 91, 2 R

[56] References Cited

U.S. PATENT DOCUMENTS

| | | | |
|---|---|---|---|
| 2,201,147 | 5/1940 | Bary et al. | 187/8.72 |
| 3,229,788 | 1/1966 | Booth | 187/10 |
| 3,516,559 | 6/1970 | Walter | 414/921 |
| 3,737,009 | 6/1973 | Stoddard | 187/17 |
| 3,966,022 | 6/1976 | Cheney | 187/12 |
| 4,046,226 | 9/1977 | Flinchbaugh | 187/12 |
| 4,141,089 | 2/1979 | Krumbeck | 187/1 R |
| 4,273,498 | 6/1981 | Dickhart et al. | 414/921 |

FOREIGN PATENT DOCUMENTS

| | | | |
|---|---|---|---|
| 1084454 | 3/1980 | Canada | 414/556 |

*Primary Examiner*—Joseph J. Rolla
*Assistant Examiner*—Kenneth Noland
*Attorney, Agent, or Firm*—Robert R. Tipton

[57] ABSTRACT

A lifting platform for the handicapped for a transit system utilizes a pair of side support members mounted on a fixed base support at ground level in which the platform is located between the side supports and raised and lowered by a set of rotating actuating arms interconnected by a chain drive and sprocket wheel combination. A sprocket wheel and idler shaft combination interconnect the rotary actuating arms associated with each side support member and maintain the support platform at all times in a horizontal position while being raised and lowered. The rotating actuating arms rotate about an axis above ground level and intermediate between the high and low position of the platform. Final height adjustment is determined by the amount of rotation beyond the vertical by the rotating actuating arms.

3 Claims, 7 Drawing Figures

WAYSIDE WHEELCHAIR LIFT

BACKGROUND OF THE PRIOR ART

This invention relates generally to lifting apparatus and in particular to platform lifting apparatus for the handicapped.

The various platform lifting apparatus for the handicapped of the prior art comprised various adaptations of pulley and cable platform lifting devices or various parallelogram arm arrangements for raising and lowering a platform. Other devices for lifting platforms included various combinations of sliding ramps. All of the devices of the prior art were generally complex mechanical configurations which were costly to manufacture, costly to install and time consuming in their use.

SUMMARY OF THE INVENTION

The wayside wheelchair lift apparatus of the present invention comprises, basically, a pair of first and second side supports or housings attached to a base support adjacent one side of a support platform in which a pair of first and second rotary actuating arms are pivotally connected to one side of the platform and rotated in unison about an axis above the ground level. The combination further comprises a matching pair of third and fourth rotating actuating arms having their outer ends pivotally connected to the other side of the support platform also rotating about the same axis above the ground level. The first and second rotating actuating arms are indirectly connected to the third and fourth actuating arms to cause all rotating arms to rotate in unison. The actuating arms are adapted to rotate through an arc greater that 90 degrees whereby the support platform in its upward and downward travel passes through the extended axes of rotation of the rotating actuating arms.

It is, therefore, an object of the present invention to provide a lifting platform for a handicapped person.

It is a further object of the present invention to provide a lifting platform actuated solely by rotating actuating arms.

It is still another object of the present invention to provide a lifting apparatus in which the platform is lifted from a point below the axes of rotation of the lifting arms through the extended axes of rotation of the rotating actuating arms to a point above the axes of rotation of the lifting arms.

It is a further object of the present invention to provide an apparatus in which the rotating actuating arms on each side of the platform are interconnected indirectly to each other.

These and other objects of the present invention will become manifest upon study of the following detailed description when taken together with the drawings.

DESCRIPTION OF THE PREFERRED EMBODIMENT

Figure 1:
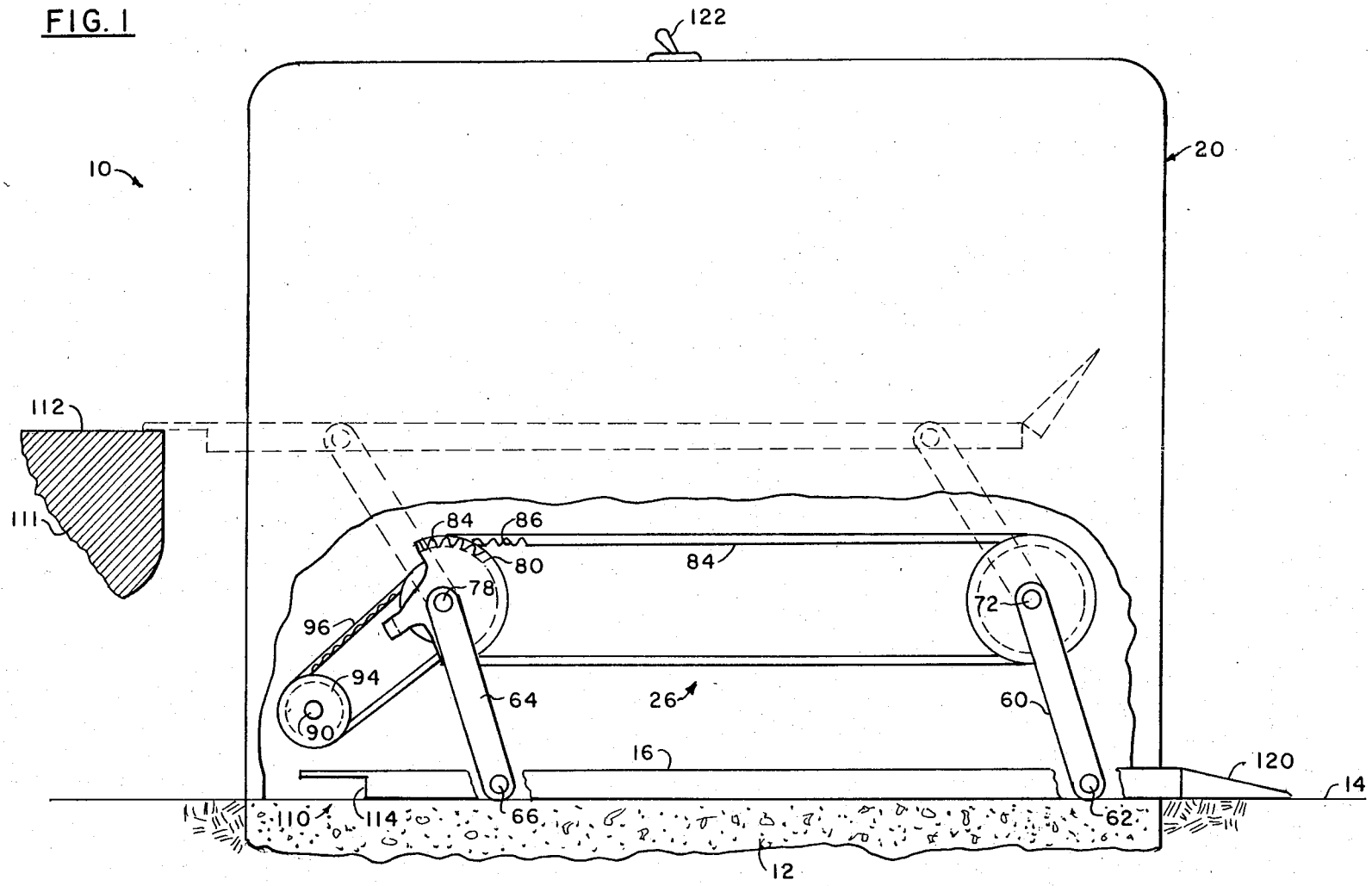
FIG. 1 is a longitudinal sectional elevational view of the lifting apparatus of the present invention taken at line 1—1 of FIG. 2.
Figure 2:
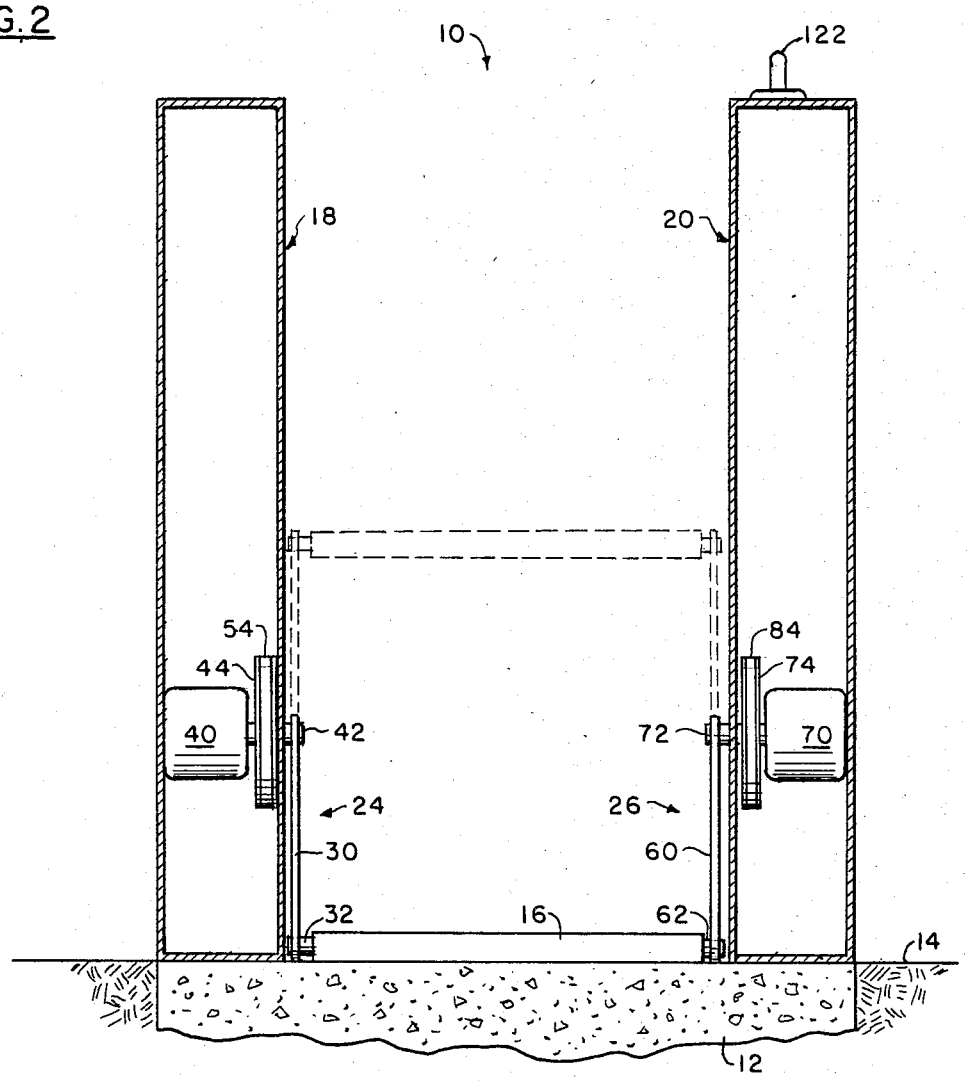
FIG. 2 is a cross-sectional elevational view of the lifting apparatus of the present invention taken at lines 2—2 of FIG. 1.

With reference to FIGS. 1 and 2 there is illustrated, respectively, a longitudinal side elevational view and a cross-sectional elevational view of the wayside wheelchair lift 10 of the present invention which comprises, basically, a base support member 12 having its top surface proximate ground level 14, a support platform 16, a first support member or housing 18 attached to said based support 12 adjacent one side of said platform 16, and a second side support member or housing 20 also attached to said base support 12 and located adjacent the other side of platform 16.

A first side lifting means or apparatus 24, located in first side support member 18, in conjunction with second side lifting apparatus 26, located within second side support member 20, are both used to raise and lower platform 16.

Figure 3:
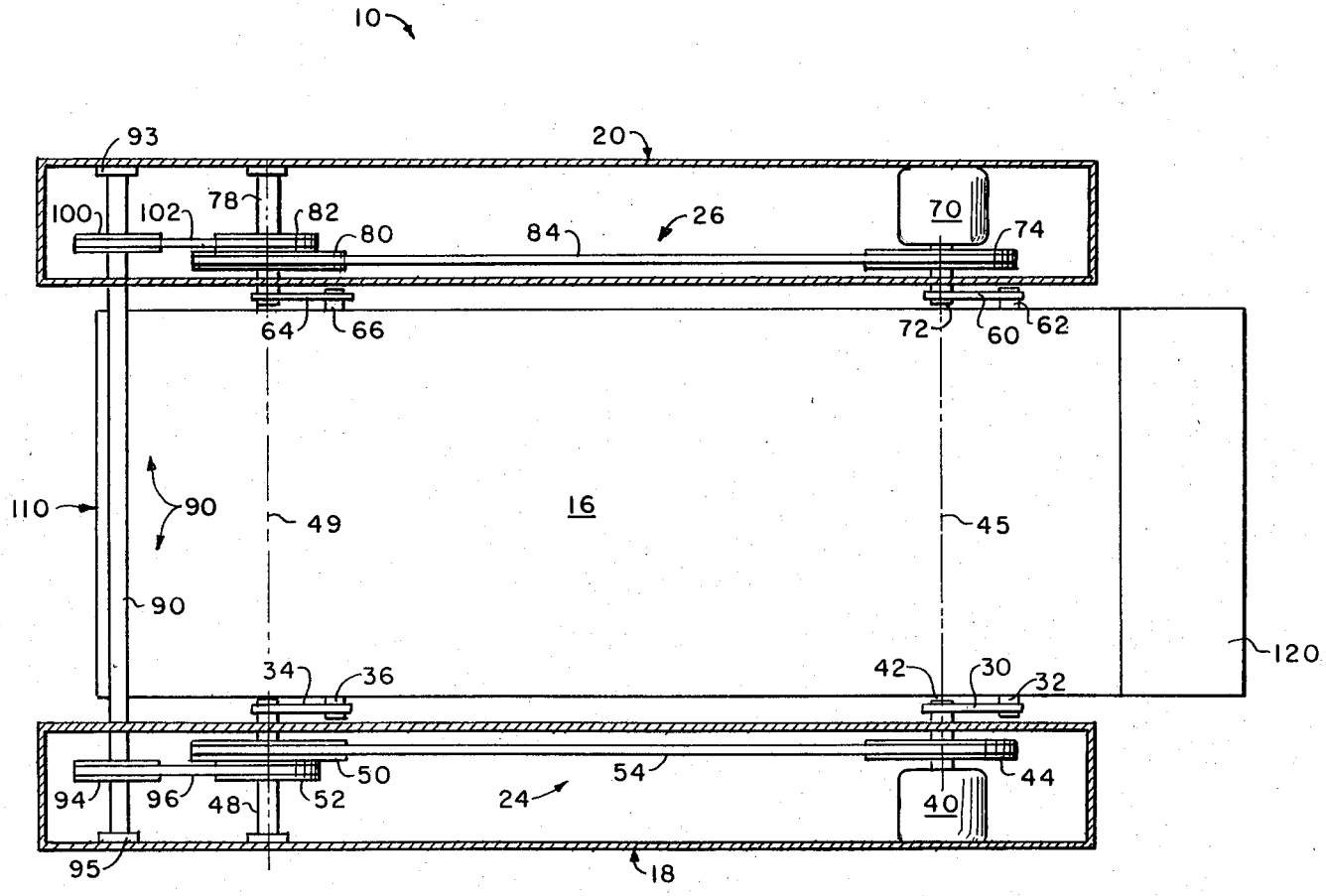
FIG. 3 is sectional plan view of the lifting apparatus of the present invention taken at lines 3—3 of FIGS. 1 and 2.

With reference to FIGS. 2 and 3, first side lifting apparatus 24 comprises, basically, a first rotating actuating arm 30 connected proximate its outer end to one side of support platform 16 by means of pivot pin 32. A second rotating actuating arm 34 is located spaced apart from said first rotating actuating arm 30 and is also pivotally connected proximate its outer end to the same side of support platform 16 by means of pivot pin 36.

First rotating actuating arm 30 is connected at it outer end to rotating vane actuator 40 through shaft or rotor 42 on which is also fixedly mounted first sprocket wheel 44. The axis of rotation of shaft 42 is adapted to be coincident with first axis of rotation 45. Second rotating actuating arm 34 is connected to shaft 48 on which is also fixedly mounted second sprocket wheel 50 and idler drive wheel 52. The axis of rotation of shaft 48 is adapted to be coincident with second axis of rotation 49.

First sprocket wheel 44 and second sprocket wheel 50 are interconnected by continuous loop chain drive 52.

The term "sprocket wheel", as used herein, is intended to include any belt or chain drive apparatus in which slippage between the belt or chain drive 84, for example, (FIG. 1), and sprocket wheel 80, for example, (FIG. 1), is prevented by use of teeth 86 (FIG. 1) on pulley or sprocket wheel 80, typically, that engage or intermesh with matching teeth or receptacles 88 (FIG. 1) in chain or belt drive 84, typically.

Similarly to first side lifting apparatus 24, a second side lifting apparatus 26 comprises, basically, a third rotating actuating arm 60 pivotally connected proximate its outer end to the other side of support platform 16 by means of pivot pin 62. A fourth rotating actuating arm 64 is also pivotally connected proximate its outer end to the other side of platform 16 by means of pivot pin 66.

Third rotating actuating arm 60 is connected, at its outer end, to rotary vane actuator 70 through shaft or rotor 72 on which is also fixedly mounted third sprocket wheel 74. The axis of rotation of shaft or rotor 72 is also adapted to be coincident with first axis of rotation 45. Fourth rotating actuating arm 64 is connected to shaft 78 on which is also fixedly mounted fourth sprocket wheel 80 and second idler drive sprocket wheel 82. The axis of rotation of shaft 78 is also adapted to be coincident with second axis of rotation 49.

A continuous loop sprocket chain 84 interconnects third sprocket wheel 74 and fourth sprocket wheel 80.

To indirectly connect first side lifting apparatus 24 to second side lifting apparatus 26, an interconnect drive means or apparatus 90 is used. Interconnect drive means 90 comprises idler drive shaft 92 journalled, at one end, to bearing 93 which is connected to first side support member 18, and at its other end, to bearing 95 which is connected to second side support member 20.

Mounted on idler shaft 92, in line with first idler drive sprocket wheel 52, is first intermediate idler sprocket wheel 94. Continuous loop idler sprocket chain 96 is used to interconnect first idler drive sprocket wheel 52 with first intermediate idler sprocket wheel 94.

Mounted on the other end of shaft 92 is second intermediate idler sprocket wheel 100 in line with second idler drive sprocket wheel 82. Continuous loop idler sprocket chain 102 is used to interconnect second idler drive sprocket wheel 82 with second intermediate idler drive sprocket wheel 100.

Figure 7:
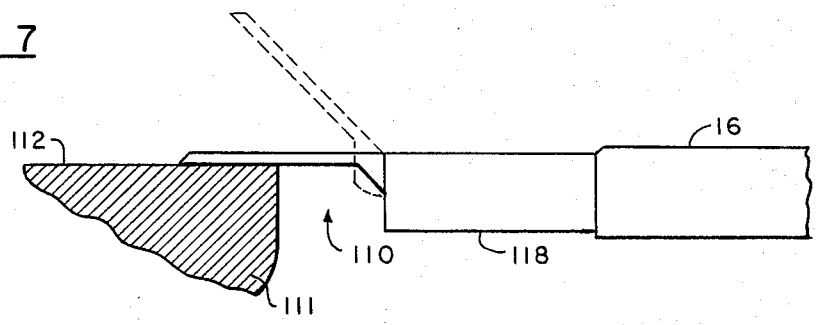
FIG. 7 is a side elevational drawing showing a bridge extension member incorporated in the lifting platform of the present invention.

At end 110 of platform 16, that is, the end of platform 16 that engages the passenger level platform or floor 112 of the transit vehicle 111, there is located a bridge extension member 114 shown in greater detail in FIG. 7.

Bridge extension member 114 comprises, basically, an extendible platform 118 adapted to telescope in and out of the end of platform 16 in order to compensate for varying distances of the transit vehicle from transit vehicle end 110 of platform 16.

To operate the wayside wheelchair lift 10 of the present invention, a passenger will enter the apparatus by traveling up entrance ramp 120 onto support platform 16. He will then actuate the apparatus using switch 122 shown mounted on the top of second side support 20. The actuation of switch 122 activates an hydraulic system, common in the art (not shown), which will provide hydraulic fluid under pressure to to one side, respectively, of vane actuators 40 and 70 causing them to rotate in unison in the same rotary direction. As illustrated in FIG. 1, the rotational direction to raise platform 16 is counter-clockwise.

First and second sprocket wheels, being interconnected by continuous loop chain drive 54, will cause first rotating actuating arm 30 and second rotating actuating arm 34 to thus rotate in unison. In a similar manner second and third sprocket wheels 74 and 80, being interconnected by fourth sprocket wheel 80 by continuous loop chain drive 84, will also cause third rotating actuating arm 60 to rotate in unison with fourth actuating arm 64.

To insure that first and second rotating actuating arms 30 and 34 of first side lifting apparatus 24 rotate in unison with third and fourth rotating actuating arms 60 and 64, respectively, of second side lifting apparatus 26, they are indirectly interconnected by idler drive means 90. This interconnecting is achieved through idler shaft 92 being interconnected with first idler drive sprocket wheel 52 of first side lifting apparatus 24 and second idler drive sprocket wheel 82 of second side lifting apparatus 26 by means of continuous loop chain drive 56 and continuous loop chain drive 102, respectively. Thus any tendency by rotary vane actuator 40 to apply more or less force to shaft 42 will cause that force to be transmitted through first idler chain drive 54, idle shaft 92 and first idler chain drive 96 to second side lifting apparatus 26.

In a like manner, any increase or decrease in rotary force provided by second side vane rotary actuator 70 will be transmitted through chain drive 84, idler drive shaft 92 and second idler chain drive 102 to first side lifting apparatus 24.

In this manner, platform 16 is always maintained on a horizontal and level position throughout the lifting operation.

Figure 4:
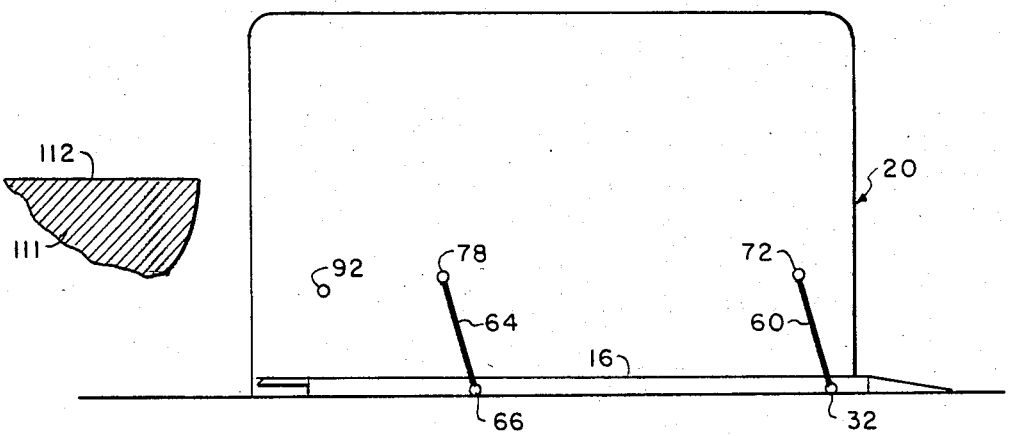
FIG. 4 is a side elevational view of a simplified drawing of the lifting apparatus of FIG. 1 showing the platform in the lowered position.
Figure 5:
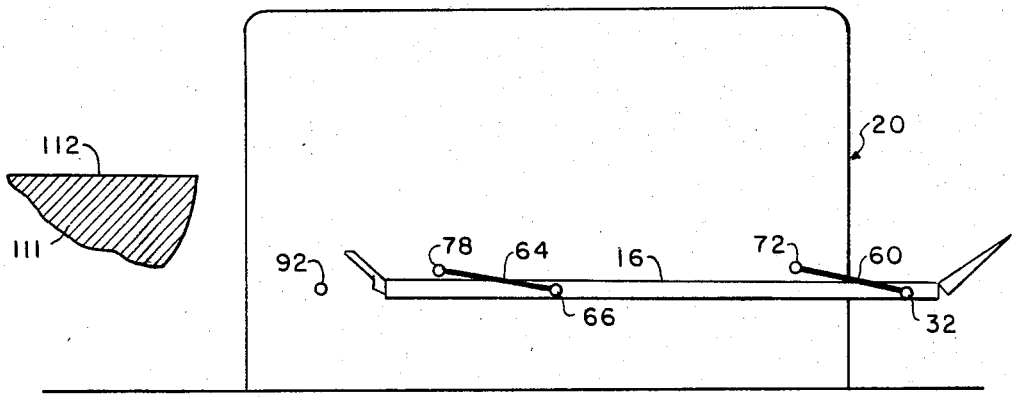
FIG. 5 is a simplified side elevation view of the apparatus of FIG. 1 showing the platform partially raised from its lowered position.
Figure 6:
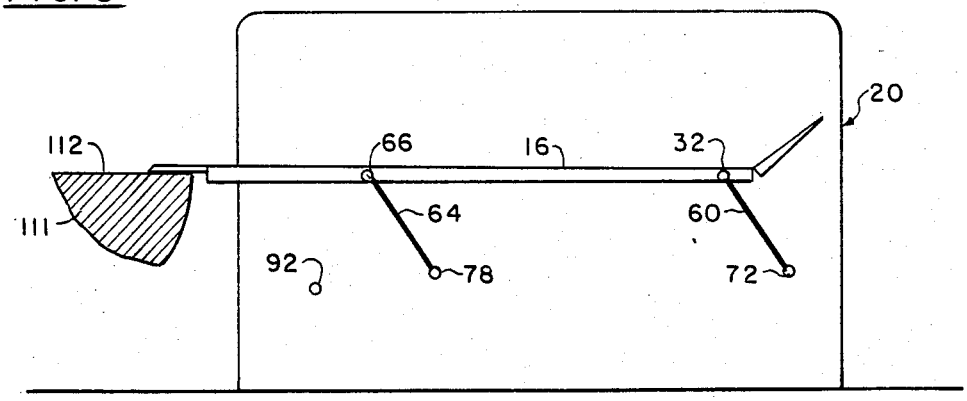
FIG. 6 is a simplified side elevational view of the apparatus of FIG. 1 showing the platform in its upper position as it would engage the entrance platform of a transit vehicle.

With reference to FIGS. 4, 5 and 6, there is illustrated a simplified diagram showing the lifting platform in various stages of operation.

FIG. 1 shows the platform 16 at its lowest or ground level.

FIG. 2 shows the platform partially raised to illustrate how the transit vehicle end 110 of platform 16 avoids interference with idler shaft 92 as platform 16 is being raised.

FIG. 6 shows platform 16 at the transit vehicle 111 passenger platform level 112. It will be noted that the forward and rearward motion of platform 16 as it travels through its upper arcuate motion will tend to adjust for height and distance from the transit vehicle.

It will be further noted that support platform 16, as it is raised and lowered, always passes through first axis of rotation 45 and second axis of rotation 49 while avoiding contact with idler shaft 92.

Further adjustment of the distance to the transit vehicle can be made by extension of bridge extension member 118. The inward and outward motion of bridge extension member 118 is achieved through an hydraulic piston and cylinder combination (not shown) common in the art.

I claim:

1. A lifting apparatus comprising:

a base support, a support platform, a first side support member attached to said base support adjacent one side of said support platform, a second side support member attached to said base support adjacent the other side of said support platform, means for raising and lowering said platform comprising a first side lifting apparatus connected to said first side support member, said first side lifting apparatus comprising a pair of spaced apart first and second rotating actuating arms pivotally connected proximate their outer ends to one side of said support platform, means for rotating said spaced apart first and second rotating actuating arms in unison, a second lifting apparatus connected to said second side support and comprising a pair of spaced apart third and fourth rotating actuating arms pivotally connected proximate their outer ends to the other side of said support platform, means for rotating said spaced apart third and fourth rotating actuating arms in unison comprising a first rotary motion actuator having a fixed housing and a rotor, said fixed housing connected to said first side support member, a first drive wheel, means for connecting said first drive wheel to said rotor of said first rotary motion actuator, means for connecting said first rotary actuator arm to said rotor, a first bearing connected to said first side support, a second drive wheel having a shaft journalled to said first bearing, means for connecting said second actuating arm to said shaft of said drive wheel, and means for interconnecting said first drive wheel with said second drive wheel, and means for interconnecting said first side lifting apparatus with said second side lifting apparatus for rotatating said first and second rotating actuating arms in unison with said third and fourth actuating arms.

2. The lifting apparatus as claimed in claim 1 wherein said first and second drive wheel comprises:

first and second sprocket wheels, respectively, and said means for interconnecting said first drive wheel with said second drive wheel comprises a continuous loop sprocket chain adapted to engage said first and second sprocket wheels.

3. A lifting apparatus comprising:

a base support, a support platform, a first side support member attached to said base support, said first side support member having a front end and a rear end, a second side support member attached to said base support and spaced apart from said first side support member, said second side support member having a front end and a rear end, a first sprocket wheel pivotally connected to said first side support proximate its front end, a second sprocket wheel pivotally connected to said first side support proximate its rear end, a first sprocket chain adapted to interconnect said first and second sprocket wheels together and cause them to rotate in unison, a first actuating arm adapted to rotate with said first sprocket wheel and having its outer end pivotally connected to one side of said support platform, a second actuating arm adapted to rotate with said second sprocket wheel and having its outer end pivotally connected to the other side of said support platform as said first actuating arm, a third sprocket wheel pivotally connected to said second side support member proximate its front end, a fourth sprocket wheel pivotally connected to said second side support member proximate its rear end, a second sprocket chain adapted to interconnect said third and fourth sprocket wheel together and cause them to rotate in unison, a third actuating arm adapted to rotate with said third sprocket wheel and having its outer end pivotally connected to the other side of said support platform, a fourth actuating arm adapted to rotate with said fourth sprocket wheel and having its outer end pivotally connected to the same side of support platform as said third actuating arm, and means for interconnecting said first and second sprocket wheels to said third and fourth sprocket wheels.

* * * * *